United States Patent [19]

Manke

[11] Patent Number: 4,646,838

[45] Date of Patent: Mar. 3, 1987

[54] LOW PRESSURE RESPONSIVE TESTER VALVE WITH SPRING RETAINING MEANS

[75] Inventor: Kevin R. Manke, Marlow, Okla.

[73] Assignee: Halliburton Company, Duncan, Okla.

[21] Appl. No.: 808,925

[22] Filed: Dec. 12, 1985

[51] Int. Cl.[4] ..... E21B 34/08

[52] U.S. Cl. ..... 166/321; 166/323; 166/331

[58] Field of Search ..... 166/264, 319, 321, 323, 166/324, 330, 331, 332, 374, 387

[56] References Cited

U.S. PATENT DOCUMENTS

| | | | |
|---|---|---|---|
| 3,856,085 | 12/1974 | Holden et al. | 166/264 |
| 4,105,075 | 8/1978 | Helmus | 166/264 |
| 4,113,012 | 9/1978 | Evans et al. | 166/264 |
| 4,125,165 | 11/1978 | Helmus | 166/264 |
| 4,355,685 | 10/1982 | Beck | 166/240 |
| 4,422,506 | 12/1983 | Beck | 166/324 |
| 4,429,748 | 2/1984 | Beck | 166/324 |
| 4,448,254 | 5/1984 | Barrington | 166/373 |
| 4,537,258 | 8/1985 | Beck | 166/374 |
| 4,553,598 | 11/1985 | Meek et al. | 166/264 |
| 4,557,333 | 12/1985 | Beck | 166/374 |

*Primary Examiner*—Stephen J. Novosad
*Assistant Examiner*—William P. Neuder
*Attorney, Agent, or Firm*—James R. Duzan; L. Wayne Beavers

[57] ABSTRACT

An annulus pressure responsive tester valve has a housing with a flow passage disposed therethrough. A full opening ball valve is disposed in the housing. A differential pressure responsive power piston is slidably disposed in the housing and operatively connected to the ball valve. A resilient spring retaining assembly is operatively associated with the power piston ad the housing for releasably retaining the power piston in a position corresponding to an open position of the ball valve until a force urging the power piston toward a position corresponding to a closed position of the ball valve exceeds a retaining force provided by the resilient spring retaining assembly. This, combined with an appropriate selection of flow restrictors in a metering cartridge associated with a compressed nitrogen chamber located below the power piston, allows the tester valve to have its ball valve left in an open position by bleeding off well annulus pressure at a sufficiently low rate.

15 Claims, 11 Drawing Figures

LOW PRESSURE RESPONSIVE TESTER VALVE WITH SPRING RETAINING MEANS

BACKGROUND OF THE INVENTION

1. Field of the Invention

The present invention relates to annulus pressure responsive downhole tools. Particularly, the present invention provides a low pressure responsive tester valve.

2. Description of the Prior Art

It is well known in the art that downhole tools such as testing valves, circulating valves and samplers can be operated by varying the pressure of fluid in a well annulus and applying that pressure to a differential pressure piston within the tool.

The assignee of the present invention has recently developed an annulus pressure responsive tool which operates in response to a relatively low annulus pressure increase as shown in U.S. Pat. Nos. 4,422,506 and 4,429,748, both to Beck and assigned to the assignee of the present invention.

These low pressure responsive tools shown in U.S. Pat. Nos. 4,442,506 and 4,429,748 have a power piston which is exposed to well annulus pressure from above, and which has its lower surface exposed to pressurized nitrogen gas in a nitrogen chamber located therebelow. Located below the nitrogen chamber is a metering chamber or equalizing chamber which is filled with oil. A floating piston separates the gas in the gas chamber from the oil in the metering chamber. Disposed in the metering chamber is a metering cartridge which provides a resistance to flow of oil therethrough. The lower end of the metering chamber below the metering cartridge is communicated with well annulus pressure, and a second floating piston separates the oil in the metering chamber from well fluid which enters the lower end of the metering chamber. An increase in well annulus pressure is immediately communicated to the upper surface of the power piston, but is delayed for a significant period of time in being fully communicated to the lower side of the power piston, so that a rapid increase in well annulus pressure will cause a downward pressure differential across the power piston to move the power piston and actuate the tool.

A number of modifications of the basic low pressure responsive tool have been developed by the assignee of the present invention as illustrated in U.S. Pat. No. 4,537,258 to Beck.

One particular feature of such tools to which many of the alternative designs developed by the assignee of the present invention have been directed is the provision of a means for controlling the position of the tester valve during changes in well annulus pressure. That is, while the normal operation of the tool provides for opening and closing of the ball valve in response to reciprocating motion of the power piston, it is sometimes desired to be able to maintain the ball valve in either a closed or an open position during changes in well annulus pressure.

One particular situation addressed by the present invention is the need to leave the tester valve open without maintaining an increased annulus pressure. This is useful when spotting fluids such as acid or cement down to the level of the subsurface formation, or when displacing fluids from the test string with nitrogen gas.

Numerous approaches have been utilized to control the movement of the valve.

Often, an actuating mandrel associated with the valve is initially shear pinned in place to hold the valve closed while running into a well, as shown for example in FIG. 2*b* of U.S. Pat. No. 4,422,506.

U.S. Pat. No. 4,429,748 to Beck discloses in FIG. 2*c* thereof a resilient ring assembly 206 to positively control the full opening and closing of the ball valve such that the ball valve is prevented from only partially opening or closing. The Beck U.S. Pat. No. 4,429,748 does not provide a means for leaving the ball valve in an open position when well annulus pressure is reduced to hydrostatic pressure. It includes a return spring 408 which will reclose the ball valve regardless of how slowly well annulus pressure is reduced.

U.S. Pat. No. 4,537,258 to Beck discloses several embodiments of such tools. The embodiment disclosed in FIGS. 2A–2E and FIG. 3 thereof utilizes a lug and slot arrangement disposed between the power piston and the housing for controlling movement of the power piston relative to the housing.

The embodiment disclosed in FIGS. 5A–5G of the Beck U.S. Pat. No. 4,537,258 uses a spring-loaded pin and detent arrangement 600 for locking the actuating mandrel in a position corresponding to an open position of the ball valve. Again, the spring-loaded detent arrangement 600 cannot hold the ball valve of the Beck U.S. Pat. No. 4,537,258 in an open position when well annulus pressure is reduced to hydrostatic pressure. As pointed out at column 23, lines 60–62, the coil spring 656 will overcome the releasable holding means 600 to reclose the ball valve, regardless of how slowly well annulus pressure is reduced to hydrostatic pressure.

U.S. Pat. No. 4,355,685 to Beck and assigned to the assignee of the present invention shows a circulating valve having an annulus pressure responsive operating means similar to that of the tools just discussed, and including a lug and slot arrangement disposed between the power piston and the housing as seen in FIG. 1C and FIG. 4 thereof for controlling the position of the power piston relative to the housing. The lug and slot arrangement of the Beck U.S. Pat. No. 4,537,258 includes a spring biased ball 124 seen in FIGS. 1C, 5 and 6, which is structurally somewhat similar to the spring-loaded ball 426 seen in FIG. 2C and FIGS. 3, 4 and 5 of the present application, although the ball 124 of the Beck U.S. Pat. No. 4,537,258 serves a completely different purpose than does the ball shown in the present invention.

Another device recently developed by the assignee of the present invention is a multi-mode testing tool shown in U.S. patent application Ser. No. 596,321, filed Apr. 3, 1984, of Ringgenberg. It is noted that application Ser. No. 596,321 itself is not prior art to the present invention; that application is being referred to only as a convenient means for describing one embodiment of the tool shown therein which is a part of the prior art. Application Ser. No. 596,321 shows several embodiments of a ratchet means for operably connecting an actuating mandrel to a power piston to control the opening and closing of the valve in response to changes in well annulus pressure, but only the embodiment shown in FIG. 10 thereof is a part of the prior art.

One prior art apparatus which can have its valve means left in an open position in response to a relatively slow bleed-off of well annulus pressure is that disclosed in FIGS. 5C and 5D of U.S. Pat. No. 4,448,254 to Barrington, and assigned to the assignee of the present invention. The Barrington device operates based upon compression of silicone oil, rather than compression of an inert gas. The embodiment shown in FIGS. 5C and 5D of Barrington does not include a releasable retaining means for retaining the power piston in a position corresponding to an open position of the valve, as pointed out at column 13, lines 17–19 of that patent. Utilizing the device of FIGS. 5C and 5D of the Barrington U.S. Pat. No. 4,448,254, it is possible to leave the ball valve in its open position if well annulus pressure is slowly reduced to hydrostatic pressure.

The Barrington device was provided with a fluid restriction having a larger flow path in the depressurizing passage than was provided in the pressurizing passage of its metering cartridge, so that a shorter time delay was provided for well annulus pressure decreases than for well annulus pressure increases. The time delay provided for well annulus pressure decreases was approximately two-thirds that provided for comparable well annulus pressure increases.

The Barrington U.S. Pat. No. 4,448,254 included both a main power piston 400 and a booster piston 402 as seen in FIGS. 5C and 5D and described at columns 13–15 of that patent. The booster piston 402 aided in the ability of that tool to be left in an open position, because if well annulus pressure was bled off somewhat faster than could be relieved by the fluid restrictor of the depressurizing passage, the booster piston 402 could move upwards to accommodate the upward differential pressure surge without moving the power mandrel upwards and reclosing the ball valve.

SUMMARY OF THE INVENTION

The present invention provides an annulus pressure responsive valve apparatus having a housing with a flow passage disposed therethrough.

A valve means is disposed in the flow passage and is movable between a closed position wherein the flow passage is closed, and an open position wherein the flow passage is open.

A differential pressure responsive power piston means is slidably disposed in the housing and operably associated with the valve means. The power piston means has first and second positions relative to the housing, corresponding to the closed and open positions, respectively, of the valve means.

A resilient spring retaining means is operably associated with the power piston means and the housing for releasably retaining the power piston means in its second position relative to the housing corresponding to the open position of the valve means until a force urging the power piston from its second position toward its first position exceeds a retaining force provided by the retaining means.

First and second pressure conducting passage means communicate a well annulus with first and second sides, respectively, of the power piston means.

A pressure transmission retarding means, in the form of a metering cartridge, is disposed in the second pressure conducting passage means.

This retarding means delays communication of a relatively rapid increase in well annulus pressure to the second side of the power piston means for a sufficient time to allow a pressure differential across the power piston means to move the power piston means from its first to its second position to open the valve means.

The retarding means delays communication of a relatively rapid decrease in well annulus pressure to the second side of the power piston means for a sufficient time to allow a pressure differential across the power piston means to overcome the retaining force of the retaining means and to move the power piston means from its second to its first position to close the valve means.

The retarding means communicates a relatively slow decrease in well annulus pressure to the second side of the power piston means quickly enough that a pressure differential across the power piston means remains below that required to overcome the retaining force of the retaining means, so that the power piston means may remain in its second position and the valve means may remain open when well annulus pressure is slowly reduced to hydrostatic pressure.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 3, the power mandrel is in its first position corresponding to the closed position of the ball valve. In FIG. 4, the power mandrel has moved approximately one-half the way from its first position to its second position. In FIG. 5, the power mandrel is in its second position relative to the housing, corresponding to an open position of the ball valve.

DETAILED DESCRIPTION OF THE PREFERRED EMBODIMENTS

Figure 1A:
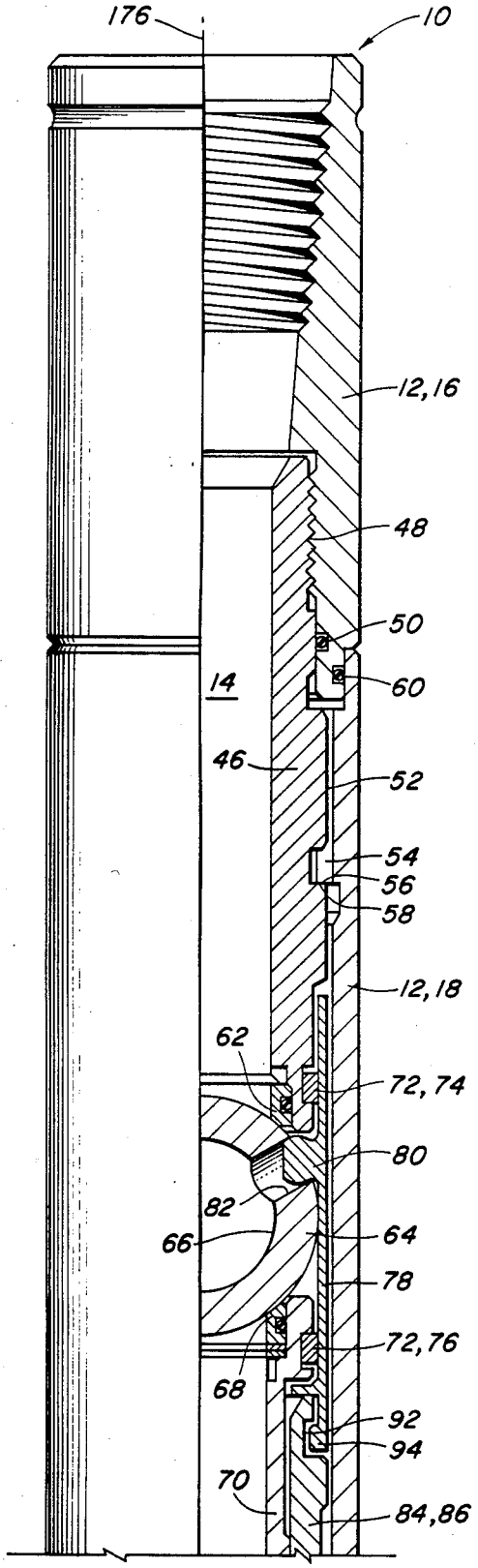
FIGS. 1A–1F comprise an elevation right side only sectioned view of a first embodiment of the tester valve of the present invention with the ball valve thereof in a closed position.

During the course of drilling an oil well, the bore hole is filled with a fluid known as drilling fluid or drilling mud. One of the purposes of this drilling fluid is to contain in intersected formations any formation fluid which may be found therein. To contain these formation fluids, the drilling mud is weighted with various additives so that the hydrostatic pressure of the mud at the formation depth is sufficient to maintain the formation fluid within the formation without allowing it to escape into the bore hole.

When it is desired to test the production capabilities of the formation, a testing string is lowered into the bore hole to the formation depth and the formation fluid is allowed to flow into the string in a controlled testing program. Lower pressure is maintained in the interior of the testing string as it is lowered into the bore hole. This is usually done by keeping a valve in the closed position near the lower end of the testing string. When the testing depth is reached, a packer is set to seal the bore hole thus closing in the formation from the hydrostatic pressure of the drilling fluid in the well annulus.

The valve at the lower end of the testing string, which is generally referred to as a tester valve, is then opened and the formation fluid, free from the restraining pressure of the drilling fluid, can flow into the interior of the testing string.

The testing string will include a number of tools, many of which may be constructed to be operated in response to changes in pressure within the well annulus.

A detailed description of the general makeup of such a testing string as utilized in an offshore environment, and indicating the location of a tester valve in such a string, is shown, for example, in U.S. Pat. No. 4,429,748 to Beck with regard to FIG. 1 thereof, the details of which are incorporated herein by reference.

EMBODIMENT OF FIGS. 1A–1F

Referring now to FIGS. 1A–1F of the present application, the tester valve apparatus of the present invention is shown and generally designated by the numeral 10. The tester valve 10 includes a housing 12 having a central flow passage 14 disposed longitudinally therethrough.

The housing 12 includes an upper adapter 16, a valve housing section 18, a connector nipple or shear pin nipple 20, a power housing section 22, an upper filler nipple 24, a nitrogen chamber housing section 26 including inner and outer tubular members 28 and 30, a lower extension mandrel 32 connected to inner tubular member 28, a lower filler nipple 34, an equalizing chamber housing section 36 including inner and outer tubular members 38 and 40, a metering cartridge 42 connecting lower extension mandrel 32 and inner member 38, and a lower adapter 44.

Referring to FIG. 1A, an upper seat holder 46 is threadedly connected to upper adapter 16 at threaded connection 48 with a seal being provided therebetween by O-ring 50.

Upper seat holder 46 has a plurality of radially outward extending splines 52 which mesh with a plurality of radially inward extending splines 54 of valve housing section 18.

Upper seat holder 46 includes an annular upward facing shoulder 56 which engages lower ends 58 of the splines 54 of valve housing section 18 to thereby hold valve housing section 18 in place with the lower end of upper adapter 16 received in the upper end of valve housing section 18 with a seal being provided therebetween by O-ring 60.

An annular upper valve seat 62 is received in upper seat holder 46, and a spherical ball valve member 64 engages upper seat 62. Ball valve member 64 has a bore 66 disposed therethrough. In FIG. 1A, the ball valve member 64 is shown in its closed position so that the bore 66 of ball valve 64 is isolated from the central flow passage 14 of the tester valve 10. As will further be described below, when the ball valve 64 is rotated to its open position, the bore 66 thereof is aligned with the longitudinal flow passage 14 of tester valve 10.

The ball valve 64 is held between the upper seat 62 and a lower annular seat 68. Lower annular seat 68 is received in a lower seat holder mandrel 70.

Lower seat holder mandrel 70 is held in place relative to upper seat holder 46 by a plurality of C-clamps such as the C-clamp 72 which has upper and lower ends 74 and 76 shown in FIG. 1A.

An actuating arm 78 has an actuating lug 80 disposed thereon which engages an eccentric bore 82 disposed through the side of ball valve member 64 so that the ball valve member 64 may be rotated to an open position upon downward movement of actuating arm 78 relative to the housing 12.

Actually, there are two such actuating arms 78 with lugs 80 engaging two eccentric bores such as 82 in a manner such as that illustrated and described in detail in U.S. Pat. No. 3,856,085 to Holden et al., and assigned to the assignee of the present invention.

A connector assembly 84 includes an upper connector piece 86 and a lower connector piece 88 threadedly connected together at threaded connection 90.

Upper piece 86 has a radially outer annular groove 92 disposed therein which engages a radially inwardly extending shoulder 94 of actuating arm 78 so that actuating arm 78 reciprocates with connector assembly 84 within the housing 12.

The lower seat holder mandrel 70 has an outer surface 96 closely received within an inner cylindrical bore 98 of upper piece 86 with a seal being provided therebetween by O-ring 100.

An actuating mandrel 102 has a cap 112 threadedly connected to the upper end thereof at threaded connection 114. Cap 112 is trapped between a downward facing shoulder 116 of upper piece 86 of connector assembly 84 and an upper end 118 of lower piece 88 of connector assembly 84.

Figure 1B:
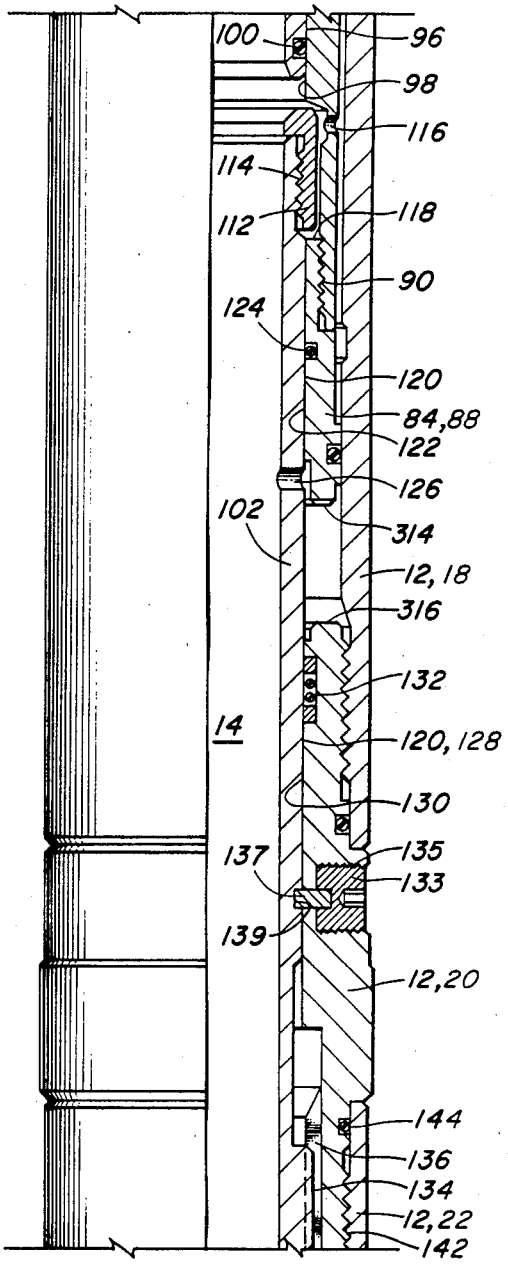

Thus, except for the slight clearance which is apparent in FIG. 1B between cap 112 and upper end 118 of lower piece 88, the connector assembly 84 will move with actuating mandrel 102 within the housing 12. As previously mentioned, a downward movement of actuating arm 78, which would be caused by downward movement of actuating mandrel 102, will rotate the ball valve 64 to an open position.

An outer surface 120 of actuating mandrel 102 is closely received with a bore 122 of lower piece 88 with a seal being provided therebetween by O-ring 124.

A plurality of relief ports 126 are radially disposed through actuating mandrel 102.

An intermediate portion 128 of outer surface 120 of actuating mandrel 102 is closely received within a bore 130 of connector nipple 20 with a seal being provided therebetween by O-ring seal means 132.

Figure 1C:
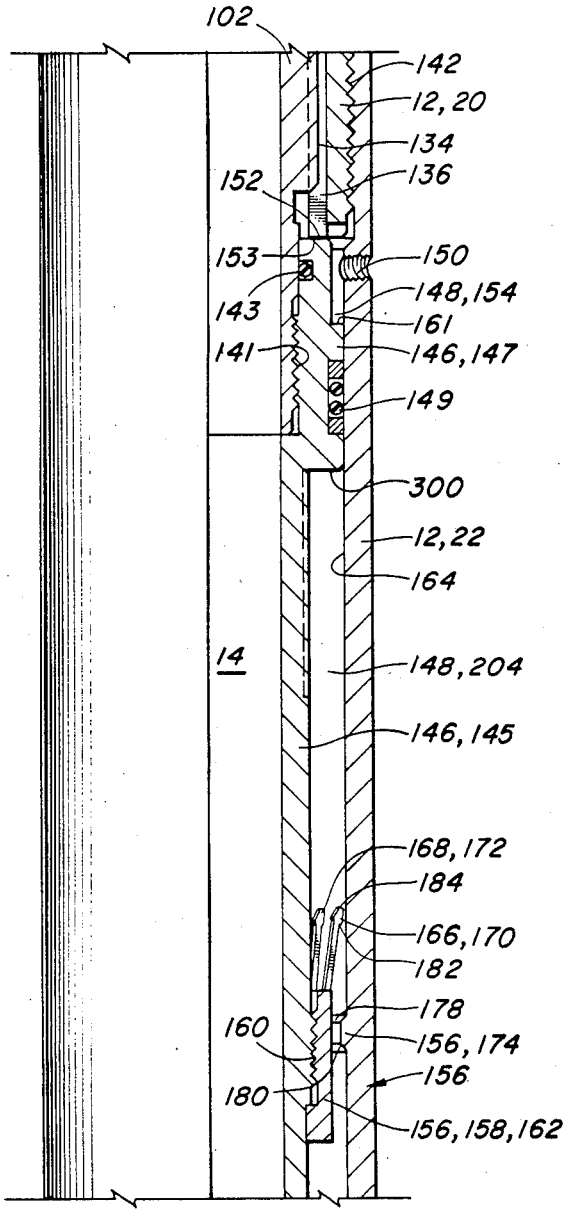

Connector nipple 20 has a plurality of shear pin holders such as 133 received in threaded radial bores such as 135 thereof. Each of the shear pin holders such as 133 has a shear pin such as 137 received therein and extending radially inward into engagement with an annular groove 139 of actuating mandrel 102. The shear pins 137 hold the actuating mandrel 102 in an initial position as illustrated in FIGS. 1A–1C corresponding to the closed position of the ball valve 64 as seen in FIG. 1A.

Actuating mandrel 102 includes a plurality of radially outward extending splines 134 which are engaged with a plurality of radially inward extending splines 136 of connector nipple 20.

The lower end of connector nipple 20 is connected to power housing section 22 at threaded connection 142 with a seal being provided therebetween by O-ring 144.

An annular power piston means 146 is threadedly connected to a lower end of actuating mandrel 102 at threaded connection 141 with a seal being provided therebetween by O-ring 143.

Power piston means 146 includes an elongated power mandrel portion 145 having an enlarged diameter power piston 147 integrally formed on the upper end thereof.

The power piston 147 is slidably received within a cylindrical inner bore 164 of power housing section 22, with a seal being provided therebetween by piston seal 149.

A power port 150 is disposed through power housing section 22 above the enlarged diameter power piston 147 for communicating a well annulus exterior of the housing 12 with an upper portion 154 of an annular chamber 148 defined between the power piston means 146 and power housing section 22.

Power piston means 146 has an upper end 152 which abuts lower ends 153 of splines 136 of connector nipple 20 to define an upwardmost position of the power piston means 146 relative to the housing 12, corresponding to the closed position of ball valve 64.

A resilient spring retaining means 156 is shown in FIG. 1C, and is operatively associated with the power piston means 146 and the housing 12 for releasably retaining the power piston means in a second position relative to the housing 12 corresponding to an open position of the ball valve 64 until a force urging the power piston means 146 upward from its second position toward its first position exceeds a retaining force provided by the retaining means 156 as is further explained below.

The retaining means 156 generally includes a spring means 158 longitudinally fixed relative to the power piston means 146 at the threaded connection 160 so that the spring means 158 moves longitudinally with the power piston means 146 relative to the housing 12. The spring means 158 includes an annular base 162 having a plurality of cantilevered spring fingers such as 166 and 168 with fixed ends integrally formed with the base 162, and each having a free end such as 170 and 172 extending radially outward from the power piston means 146 toward and into continuous sliding engagement with the inner cylindrical bore 164 of power housing section 22.

The resilient spring retaining means 156 also includes an abutment means 174 integrally formed with and extending radially inward from the power housing section 12.

The abutment means 174 can generally be described as a radially inward extending ledge 174 having tapered upward and downward facing annular surfaces 178 and 180, respectively.

When the power piston means 146 is moved downward relative to power housing 12 in response to increases in well annulus pressure, the cantilevered spring fingers such as 166 and 168 will have their lowered tapered surfaces such as 182 engaged with the upward facing tapered surface 178 of abutment 174 thus camming the cantilevered spring fingers such as 166 and 168 radially inward so that they may pass downward to a position below the annular ledge abutment 174.

When the cantilevered spring fingers such as 166 and 168 are located below the ledge abutment 174, their tapered upper surfaces such as 184 will engage downward facing tapered surface 180 of annular ledge 174 if an upward force is imposed upon the power piston means 146.

A retaining force of the retaining means 156 is defined as the upward force required to cause the free ends 170 and 172 of the cantilevered spring fingers such as 166 and 168 to be cammed radially inward by the downward facing tapered surface 180 of annular ledge 174 so that the cantilevered spring fingers such as 166 and 168 may be moved upward past the annular ledge 174.

Upper tapered surface 178 has a less steep taper than does lower tapered surface 180. The tapered surfaces 182 and 184 of the free end 170 of cantilevered spring finger 166 have identical angles of taper. Thus, it is apparent that the spring fingers such as 166 can be moved downward past ledge 156 by a lower starting force than that required to move them upward past ledge 156.

A longitudinal central axis of the housing 12 is identified by the numeral 176 as indicated at the upper end of FIG. 1A.

A lower portion 186 of power piston means 146 is closely and slidably received within a bore 188 of upper filler nipple 24 and a pair of O-ring seal means 190 and 192 are provided therebetween.

A relief port 194 communicates a groove 196 disposed in the bore 188 of upper filler nipple 24 between seals 190 and 192 to prevent hydraulic lockup of the power piston means 146.

A lower end of the power housing section 22 is threadedly connected to upper filler nipple 24 at threaded connection 198 with a seal being provided therebetween by O-ring seal means 200.

Figure 1D:
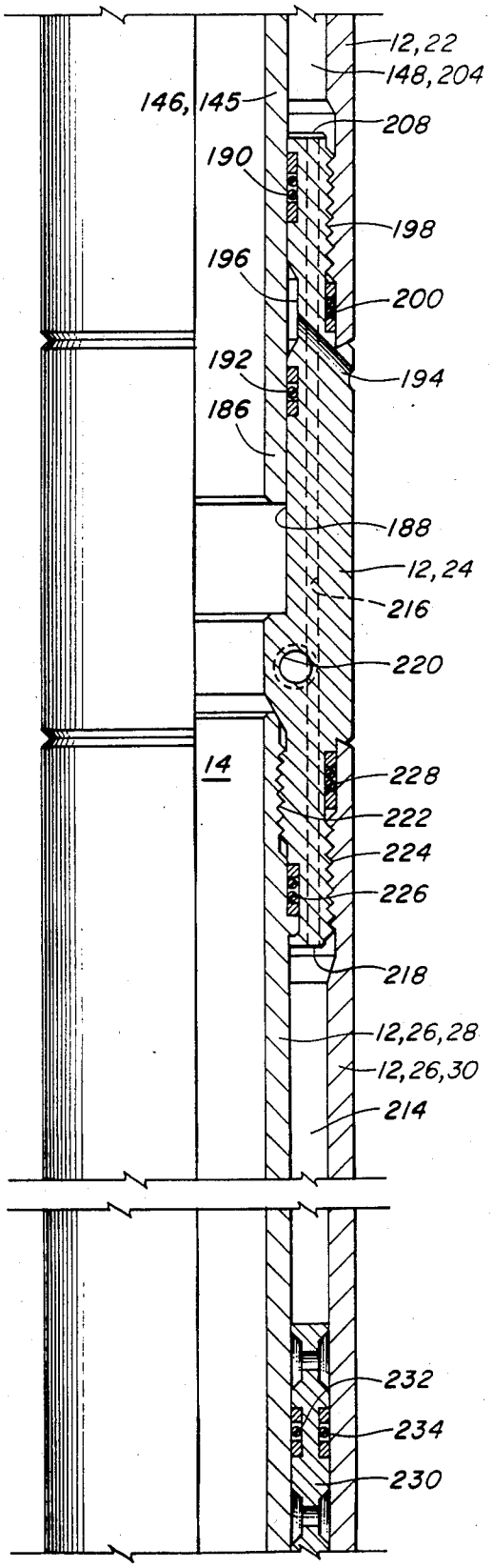

An annular nitrogen chamber 214 is defined between inner and outer tubular members 28 and 30 of nitrogen housing section 26 of housing 12 as seen in FIG. 1D.

Upper filler nipple 24 has a plurality of longitudinal ports 216 disposed therethrough connecting its upper end 208 with a lower end 218 thereof, for communicating the nitrogen chamber 214 with a lower portion 204 of annular chamber 148.

A conventional filler valve (not shown) is disposed in a transverse bore 220 of upper filler nipple 24, which communicates with one of the longitudinal ports 216 for filling the nitrogen chamber 214 and the lower portion 204 of chamber 148 with a high pressure nitrogen gas. Typically, the nitrogen gas will be pressurized prior to placing the tester valve 10 in a well, to a pressure in the range of 1000 to 7000 psi. The actual charge pressure for any given job will depend upon the hydrostatic pressure and the temperature present in the well at the depth of the formation. For example, a formation at a depth such that the hydrostatic well annulus pressure is 4000 psi, and at typical temperatures, would require a nitrogen gas charge of about 3000 psi.

The inner and outer tubular members 28 and 30 of nitrogen housing section 26 of housing 12 are threadedly connected to upper filler nipple 24 at threaded connections 222 and 224, respectively, with seals being provided therebetween by O-ring seal means 226 and 228, respectively.

An annular floating piston 230 is slidably received in the lower end of nitrogen chamber 214 and has annular upper inner and outer seals 232 and 234, respectively, which slidably seal against inner tubular member 28 and outer tubular member 30 of nitrogen chamber housing section 26 of housing 12.

Piston 230 also includes lower inner and outer O-ring seals 236 and 238, respectively.

The lower extension mandrel 32 is threadedly connected to the lower end of inner tubular member 28 at threaded connection 240 with a seal being provided therebetween by O-ring 242.

A lower end of lower extension mandrel 32 is closely received within a bore 244 of metering cartridge 42 with a seal being provided therebetween by O-ring 246.

Outer tubular member 30 is threadedly connected to lower filler nipple 34 at threaded connection 248 with a seal being provided therebetween by O-ring 250. The lower end of lower filler nipple 34 is threadedly connected to outer member 40 of equalizing chamber housing section 36 at threaded connection 252 with a seal being provided therebetween by O-ring 254.

An irregular annular oil flow passage 256 is defined longitudinally between floating piston 230 and metering cartridge 42, and radially between lower extension mandrel 42 on the inside and outer tubular member 30 and lower filler nipple 34 on the outside.

The inner member 38 of equalizing chamber housing section 36 of housing 12 is connected to metering cartridge 42 at threaded connection 258 with a seal being provided therebetween by O-ring 260.

An O-ring 262 seals between an outer surface 264 of metering cartridge 42 and an inner bore 266 of outer tubular member 40.

Outer tubular member 40 has first and second oil fill ports 268 and 270 disposed therethrough which are blocked by plugs 272 and 274, respectively.

An equalizing chamber 276 is defined between inner and outer tubular members 38 and 40 of equalizing chamber housing section 36.

The metering cartridge 42 has a pressurizing passage 296 and a depressurizing passage 298 disposed longitudinally therethrough, each of which communicate the irregular annular oil flow passage 256 with the equalizing chamber 276.

A second floating piston 278 is received in the lower end of equalizing chamber 276.

Piston 278 includes radially inner and outer upper seals 280 and 282, respectively, and radially inner and outer lower seals 284 and 286, respectively.

An equalizing port 288 is disposed through outer tubular member 40 to communicate the lower end of equalizing chamber 276 below piston 278 with a well annulus exterior of the housing 12.

The inner tubular member 38 has an outer cylindrical surface 290 of a lower portion thereof closely received within a bore 292 of lower adapter 44 with a seal being provided therebetween by O-ring 294.

The power port 150 (see FIG. 1C) and the upper portion 154 of chamber 148 above power piston 147 can generally be referred to as a first pressure conducting passage means for communicating the well annulus exterior of the housing 12 with an upper first side 161 of power piston 147.

The equalizing port 288, equalizing chamber 276, pressurizing and depressurizing passages 296 and 298 through metering cartridge 42, irregular annular oil flow passage 256, nitrogen chamber 214, longitudinal ports 216 and lower portion 204 of annular chamber 148 can generally be described collectively as a second pressure conducting passage means for communicating the well annulus exterior of the housing 12 with a lower second side 300 of power piston 147.

The lower filler nipple 34 has an oil fill port 257 disposed therethrough which is blocked by a plug 259.

The irregular annular oil flow passage 256, and the equalizing chamber 276 are filled with a suitable oil by means of the oil fill ports 257, 268 and 270.

The second floating piston 278 separates the oil thereabove in the equalizing chamber 276 from well fluid which enters the equalizing port 288 therebelow.

Devices located in the pressurizing passage 296 control the flow of oil upward from equalizing chamber 276 to the bottom side 300 of power piston 146.

The pressurizing passage 296 has disposed therein a pressure relief or check valve 304 and a flow restrictor 305. Upper and lower screens 306 and 308, respectively, cover the ends of pressurizing passage 296.

The flow restrictor 305 comprises a small orifice jet which impedes the flow of oil from equalizing chamber 276 to oil flow passage 256 so as to provide a first time delay in the transmission of increases in well annulus pressure to the lower side 300 of power piston 147.

Item 304 will usually be a pressure relief valve means which allows flow in an upward direction therethrough when the pressure in equalizing chamber 276 exceeds the pressure in oil flow passage 256 by a predetermined value, for example, 400 psi. Pressure relief valve 304 does not permit flow in a downward direction through the pressurizing passage 296. In some instances, a simple one-way check valve may be substituted for the pressure relief valve 304.

The depressurizing passage 298 includes a flow restrictor 310 and a check valve 312. In some situations, a pressure relief valve may be substituted for check valve 312.

Check valve 312 allows downward flow therethrough but prevents upward flow therethrough.

Flow restrictor 310 impedes the flow of fluid downward through the depressurizing passage 298 and provides a second time delay in transmission of decreases in well annulus pressure from the well annulus to the lower side 300 of power piston 147.

In a preferred embodiment of the invention, the duration of the second time delay provided by flow restrictor 310 in depressurizing passage 298 is approximately one-half the duration of the first time delay provided by first flow restrictor 305 in pressurizing passage 296, for an equivalent well annulus pressure change. That is, for a pressure differential of a given magnitude, for example 100 psi, that pressure differential can be transmitted through the depressurizing passage 298 in approximately one-half the time it could be transmitted through the pressurizing passage 296. It must be remembered when speaking of pressure differentials transmitted through the passages 296 and 298, that passage 296 can only transmit well annulus pressure increases, and passage 298 can only transmit well annulus pressure decreases. Thus, for example, a well annulus pressure increase of 100 psi might be transmitted through pressurizing passage 296 in approximately two minutes for a typical embodiment of the invention, whereas a well annulus pressure decrease of 100 psi would be transmitted through depressurizing passage 298 in approximately one minute.

SUMMARY OF THE OPERATION OF THE EMBODIMENTS OF FIGS. 1A–1F

The tester valve 10 is generally designed so that it is normally in a closed position as illustrated in FIGS. 1A–1F. A relatively rapid increase in well annulus pressure of a sufficient magnitude will move the valve to its open position wherein the ball valve 64 is rotated 90° from the position shown in FIG. 1A so that its bore 66 is aligned with the flow passage 14 of tester valve 10.

A subsequent relatively rapid decrease in well annulus pressure back to hydrostatic pressure will normally return the ball valve 64 to its closed position.

The resilient spring retaining means 156 and the particular design of the metering cartridge 42, however, permit the ball valve 64 to be left in its open position if well annulus pressure is reduced at a relatively low rate. This is accomplished in the following manner.

The tester valve apparatus 10 will normally be made up with a well test string (not shown) like that disclosed in U.S. Pat. No. 4,429,748 to Beck.

The test string including valve apparatus 10 is lowered into a well to a desired location adjacent the subsurface formation which is to be tested. Then a packer (not shown) located in the test string below the tester valve 10 is set to seal the well annulus between the test string and the well bore. This isolates the well annulus above the packer from the internal flow passage 14 of the tester valve 10.

Subsequently, changes in well annulus pressure will create a pressure differential across the power piston means 146 to move it relative to the housing 12 to thus open and close the ball valve 64 of the tester valve 10.

Typically, the tester valve apparatus 10 will be designed to operate in response to a relatively rapid increase in well annulus pressure of approximately 1,000 psi. This is determined by the design of the shear pins 137 which initially retain the actuating mandrel 102 in position relative to the housing 12.

This increase of 1,000 psi is substantially immediately communicated to the upper side 161 of power piston 147.

This increase in well annulus pressure, however, is not immediately communicated to the lower side 300 of power piston 147. This is because of the time delay created by the fluid flow restrictor 305 in pressurizing passage 296 of metering cartridge 42. The fluid flow restrictor 305 will typically transmit the entire well annulus pressure increase therethrough in a time period of approximately two minutes.

Figure 1E:
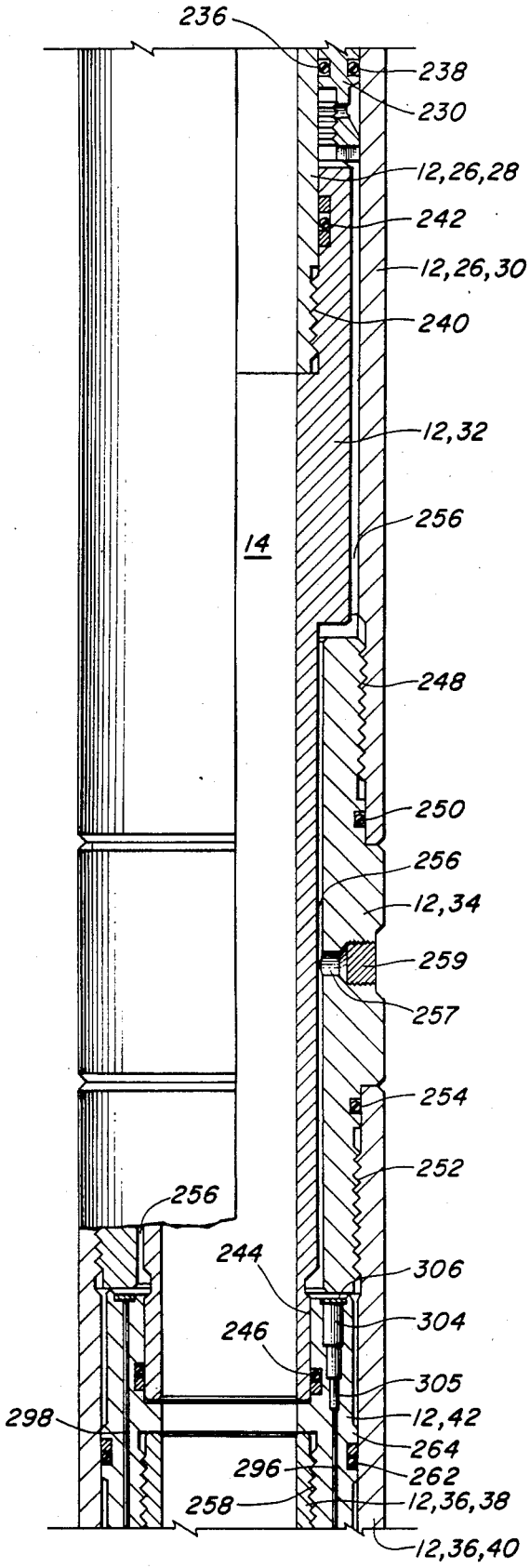
Figure 1F:
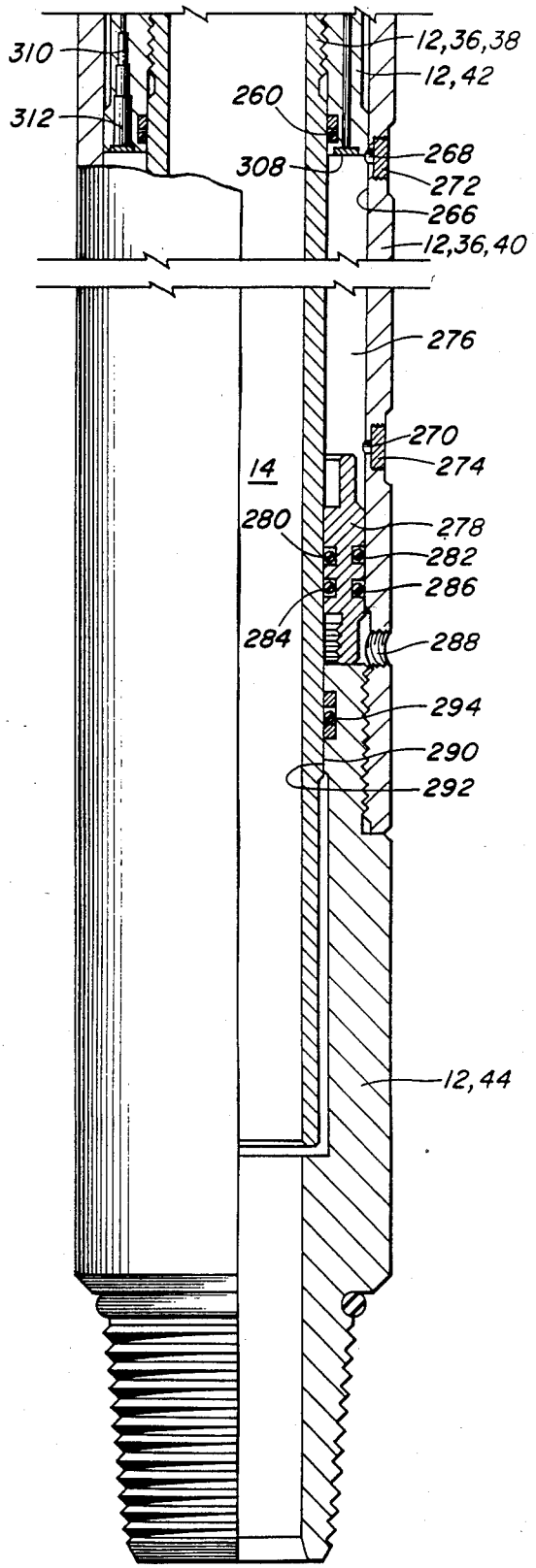

With the embodiment disclosed in FIGS. 1E–1F, the 400 psi pressure relief valve 304 will only allow 600 psi of this pressure increase to be felt on a lower side 300 of power piston 147. Thus, after a time delay on the order of two minutes, 600 psi of the 1,000 psi well annulus pressure increase will be transmitted through the pressurizing passage 296 and through the compressed nitrogen gas in nitrogen chamber 214 and the lower portion 204 of annular chamber 148 to the lower side 300 of power piston 147.

Thus, there will substantially instantaneously be a 1,000 psi downward pressure differential placed across the power piston 147. The force caused by this pressure differential will shear the shear pins 137 allowing the power piston means 146 and actuating mandrel 102 to move downward relative to the housing 12. This downward force acting upon the power piston means 146 will be sufficient to pull the spring fingers such as 166 and 168 of resilient spring retaining means 156 downward past the ledge abutment 174. The power piston means 146 will move downward in one continuous movement rotating the ball valve 64 to its open position, and will stop when a lower end 314 of lower piece 88 of connector assembly 84 abuts an upper end 316 of connector nipple 20.

So long as the well annulus pressure is maintained at the elevated value, a 400 psi downward pressure differential will remain across power piston 147.

To reclose the ball valve 64, the well annulus pressure is rapidly dropped to hydrostatic pressure. Continuing the example previously mentioned, if the well annulus pressure had been increased by 1,000 psi, this rapid drop of well annulus pressure to hydrostatic pressure will cause a 600 psi upward pressure differential across the power piston 147. The design of the resilient spring retaining means 156 is such that the 600 psi upward pressure differential will cause a force sufficient to move the cantilevered spring fingers such as 166 and 168 upward past the ledge abutment 174.

If, however, it is desired to leave the ball valve 64 in an open position when well annulus pressure is reduced to hydrostatic pressure, that can be done by reducing well annulus pressure slowly.

It may be desired to leave the valve open for a number of purposes, including for example, spotting acid down the test string, spotting cement down the test string, or displacing fluid from the test string with nitrogen gas. With the tester valve 10 of the present invention, which may be left in an open position when annulus pressure has been decreased to hydrostatic pressure, these operations can be conducted without having to remove the test string from the well to modify it and then run it back into the well.

The reduction in well annulus pressure must be slow enough that it can be communicated through the depressurizing passage 298 of metering cartridge 42 to the lower side 300 of power piston 147 quickly enough that an upward pressure differential across the power piston 147 remains below that required to overcome the retaining force provided by the resilient spring retaining means 156. Thus, by slowly bleeding off well annulus pressure, for example at a rate of 100 psi/minute or less, the ball valve 64 may be left in the open position and the power piston 147 can remain in its lower position after well annulus pressure has been slowly reduced to hydrostatic pressure.

Subsequently, when it is desired to close the ball valve 64, the pressure in the well annulus can again be increased by the same amount, for example, 1,000 psi.

This increased well annulus pressure should be maintained for a sufficient time that the pressure below the power piston 147 will reach a maximum level, namely 400 psi less than the value of the well annulus pressure. This can generally be described as communicating at least a substantial portion of this second increase in well annulus pressure through the pressurizing passage 146 to the lower side 300 of power piston 147.

Then, a rapid decrease in well annulus pressure will cause the power piston 147 to pull the resilient cantilevered spring fingers 166 and 168 upward past the abutment ledge 174 and close the ball valve 64 in its normal manner.

THE EMBODIMENT OF FIGS. 2B AND 2C

Figure 2B:
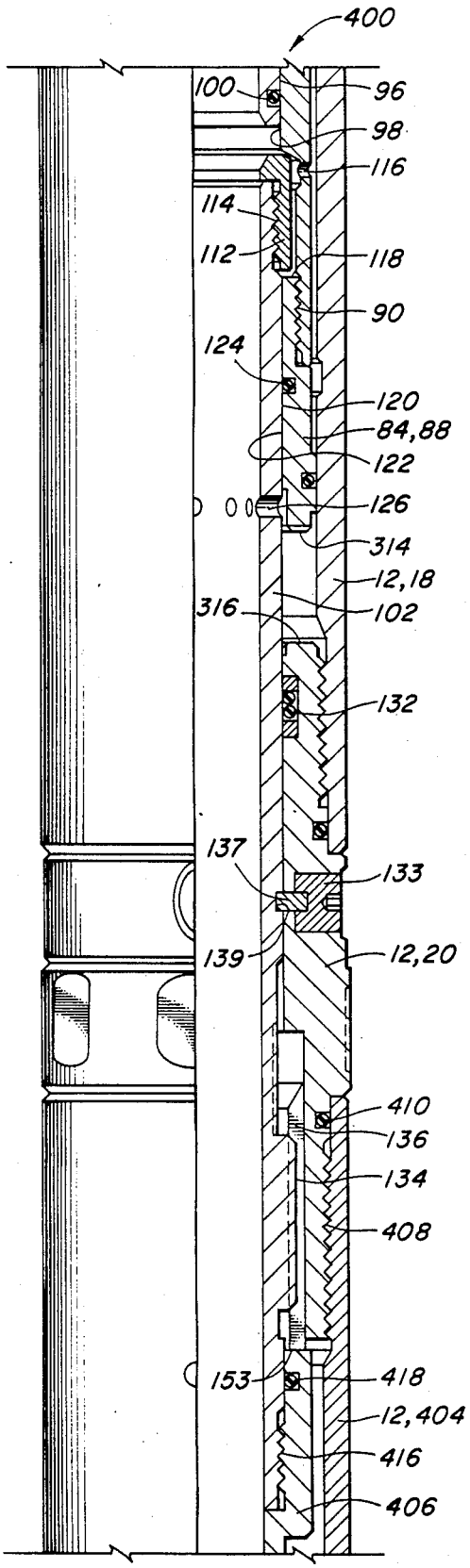
FIGS. 2B and 2C show a modified intermediate portion of a second embodiment of the tester valve of the present invention. The uppermost portion of the tester valve of FIGS. 2B and 2C is identical to that seen in FIG. 1A, and the lowermost portion of the tester valve of FIGS. 2B and 2C is identical to that shown in FIGS. 1D–1F.
Figure 2C:
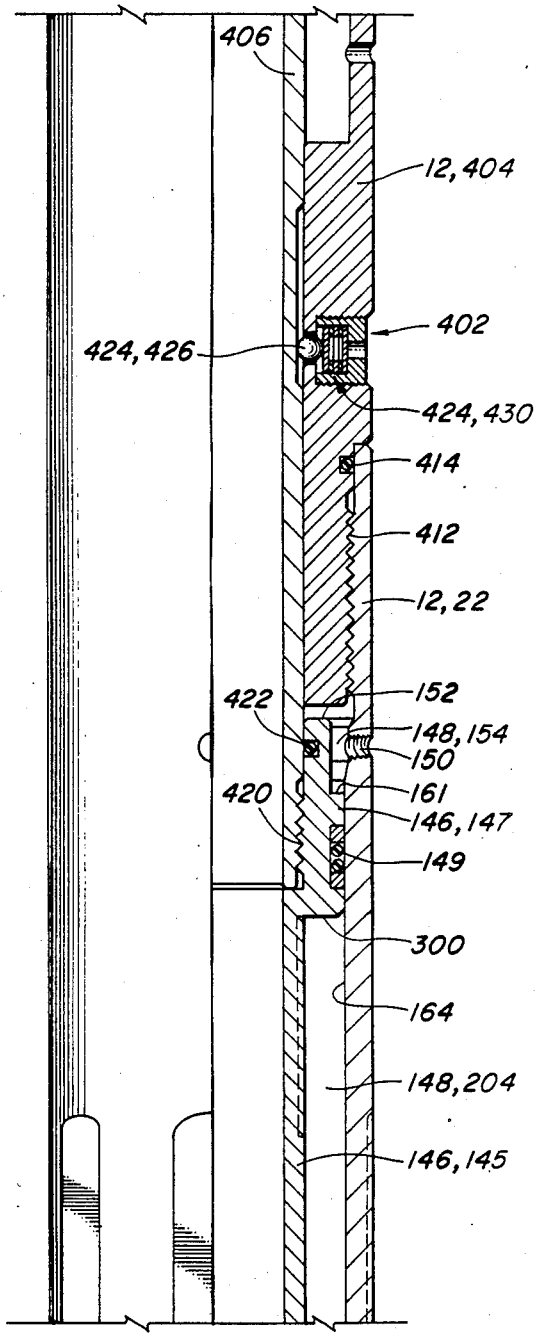

FIGS. 2B and 2C illustrate an intermediate portion of a modified tester valve generally designated by the numeral 400.

In FIGS. 2B and 2C, those elements of the tester valve 400 which are identical to the elements of tester valve 10 are shown by the same numerals as utilized in FIGS. 1B and 1C.

The uppermost portion of the tester valve 400 is identical to FIG. 1A. The lowermost portion of the tester valve 400 is identical to FIGS. 1D–1F.

The modified tester valve 400 differs from the tester valve 10 in that the resilient spring retaining means 156 of FIG. 1C has been deleted and replaced by a spring biased ball retaining means generally designated by the numeral 402 as seen in FIG. 2C.

To add the spring biased ball retaining means 402, a retaining means housing section 404 has been added to the housing 12 between connector nipple 20 and power housing section 22, and an upper power mandrel extension 406 has been connected between actuating mandrel 102 and power piston means 146.

The retaining means housing section 404 has its upper end connected to connector nipple 20 at threaded connection 408 with a seal being provided therebetween by O-ring 410.

The lower end of retaining means housing section 404 is connected to power housing section 22 at threaded connection 412 with a seal being provided therebetween by O-ring 414.

The upper power mandrel extension 406 is connected to the lower end of actuating mandrel 102 at threaded connection 416 with a seal being provided therebetween by O-ring 418. The lower end of upper power mandrel extension 406 is connected to power piston means 146 at threaded connection 420 with a seal being provided therebetween by O-ring 422.

The spring biased ball retaining means 402 can generally be described as a resilient spring retaining means operatively associated with a power piston means 146 and the housing 12 for releasably retaining the power piston means 146 in its second position relative to the housing 12 corresponding to the open position of ball valve 64 until an upward force urging the power piston means 146 from its lower second position toward its upper first position exceeds a retaining force provided by the spring biased ball retaining means 402.

Figure 5:
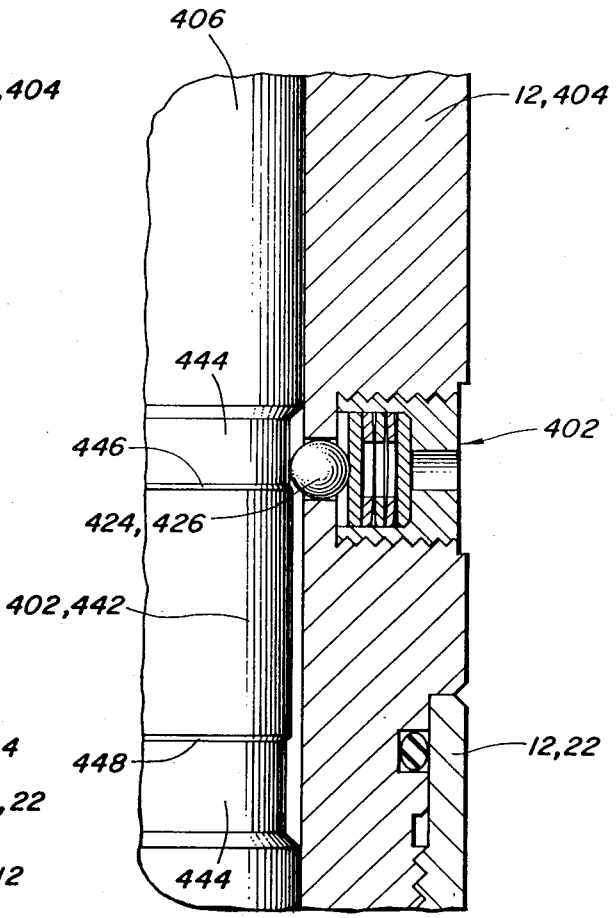
FIGS. 3, 4 and 5 are a sequential series of enlarged illustrations of the releasable retaining means of FIG. 2C.
Figure 4:
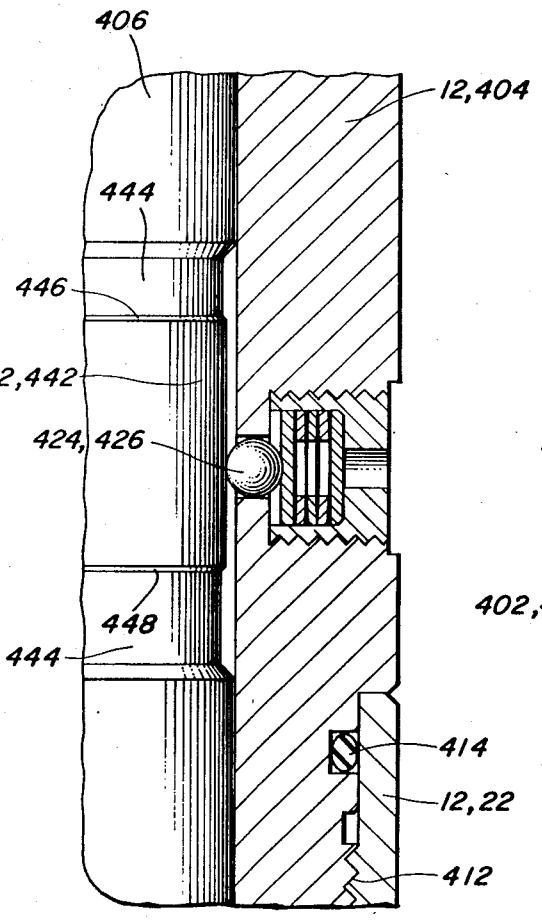
Figure 3:
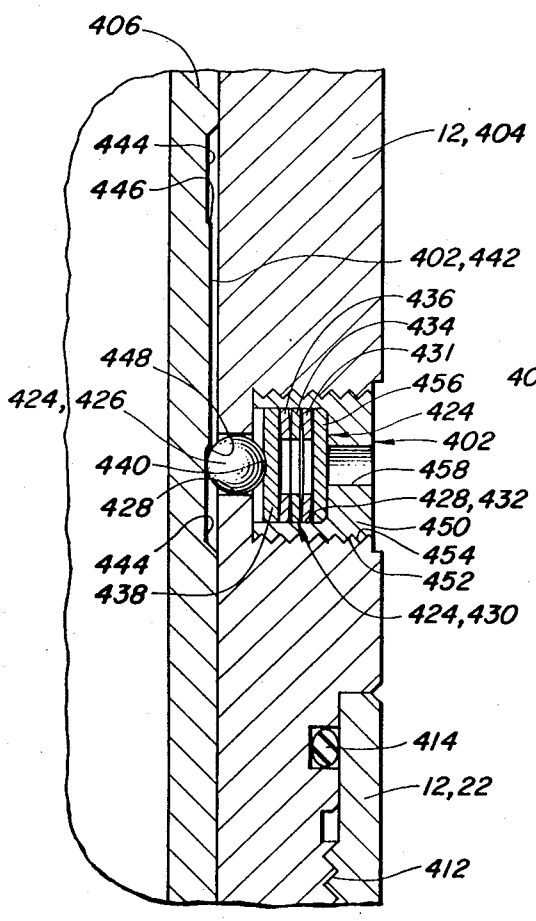

The spring biased ball retaining means 402 is best seen in FIGS. 3, 4 and 5. Upper power mandrel extension 406 is shown in cross-section elevation in FIG. 3, and in side elevation in FIGS. 4 and 5.

FIG. 3 illustrates the structure of the tester valve 400 in the same position as shown in FIG. 2C corresponding to the closed position of the ball valve 64.

The spring biased ball retaining means 402 includes a spring means 424 longitudinally fixed relative to the housing 12 so that the spring means 424 moves longitudinally with the housing 12 relative to the power piston means 146 and the upper power mandrel extension 406 which is attached to the power piston means 146. It will be understood that in the tester valve 400, it is actually the power piston means 146 and upper power mandrel extension 406 which are moving while the housing 12 remains fixed, but this can still be generally described as a relative movement of the housing 12 relative to the power piston means 146.

The spring means 424 includes a ball 426 radially slidable within a radial bore 428 of retaining means housing section 404.

Spring means 424 further includes a compressed spring 430 received in an enlarged diameter portion 432 of radial bore 428 behind the ball 426.

The enlarged diameter portion 432 of radial bore 428 is actually defined within a plug 450 which is threadedly connected at 452 to a threaded counterbore 454 of retaining means housing section 404 of housing 12.

The compressed spring 430 in the embodiment shown in FIG. 3 is a stack of three Belleville washer springs 431, 434 and 436.

The compressed spring 430 urges the ball 426 radially inward toward the upper power mandrel extension 406 which can generally be considered to be a part of the power piston means 146 since it is fixedly attached thereto.

The spring means 424 includes a solid first disc 438 located immediately between the ball 426 and the compressed spring 430. The disc 438 has a central depression or dimple 440 formed therein which closely fits a portion of the ball 426 and can thus be said to receive the ball 426 therein.

The spring means 424 further includes a second disc 456 located behind the stack of Belleville washers 431, 434 and 436. Plug 450 includes a radially outer central port 458 which communicates with the well annulus exterior of the housing 12.

The ball 426 as seen in FIG. 3 is partly received in the radial bore 428 and extends radially inward out of the radial bore 428 and into engagement with the upper power mandrel extension 406 of the power piston means 146.

The spring biased ball retaining means 402 also includes an abutment means 442 which is integrally formed with and thus can be said to be longitudinally fixed relative to the upper power mandrel extension 406.

The abutment means 442 is an annular radially outward extending ledge of the upper power mandrel extension 406. The ledge 442 is defined upon a reduced diameter portion 444 of upper power mandrel extension means 406 between an upper upset 446 and a lower upset 448.

In the particular embodiment illustrated in FIG. 3, the annular ledge abutment means extends radially outward from the reduced diameter portion 444 of upper power mandrel extension 406 by a relatively small distance on the order of 0.01 inch.

In FIG. 3, the upper power mandrel extension 406 is shown in cross section and the upsets 446 and 448 are somewhat difficult to see.

In FIGS. 4 and 5, the upper power mandrel extension 406 is shown in an elevation non-sectioned view, and the upsets 446 and 448 are a bit exaggerated to make them more visible.

FIG. 4 is an intermediate view showing the location of the upper power mandrel extension 406 when the power piston 147 has moved downward approximately one-half way between its uppermost position as represented by the position of upper power mandrel extension 406 in FIG. 3, and its lowermost position as represented by the position of the upper power mandrel extension 406 in FIG. 5.

In FIG. 3, the ball 426 of spring means 424 is located below the lower upset 448 of ledge abutment 442.

When well annulus pressure is increased and the power piston 147 and the upper power mandrel extension 406 attached thereto begin moving downward relative to the housing 12, the lower upset 448 cams the ball 426 inward compressing the stack of Belleville springs 431, 434 and 436 making up the compressed spring 430, and the ball 426 rides up on the outer cylindrical surface of ledge abutment 442 as seen in FIG. 4.

In FIG. 5, the upper power mandrel extension 406 is shown in its lowermost position corresponding to the lowermost position of power piston 147 as defined by the abutment of lower end 314 of lower piece 88 of connector assembly 84 with the upper end 316 of connector nipple 20.

With the power piston 147 and upper power mandrel extension 406 in their lowermost positions corresponding to the open position of ball valve 64, the ball 426 of spring means 424 is located above the upper upset 446 defining radially outward extension ledge abutment 442.

Thus, in order to move the power piston 147 back up to its uppermost position corresponding to the closed position of ball valve 64, the upward force on power piston 147 must be sufficient to cause upper tapered upset 446 at the upper end of ledge abutment 442 to cam the ball 426 radially outward so that the ledge abutment 442 can move upward past the ball 426 back to the position of FIG. 3.

The spring biased ball retaining means 402 shown in FIGS. 3–5 is designed so that it provides a retaining force when in the position illustrated in FIG. 5 similar to the retaining force provided by the retaining means 156 of FIG. 1C.

The operation of the tester valve 400 is substantially identical to that of the tester valve 10 previously described.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An annulus pressure responsive valve apparatus, comprising:

a housing having a flow passage disposed therethrough;

valve means, disposed in said flow passage, and movable between a closed position wherein said flow passage is closed, and an open position wherein said flow passage is open;

differential pressure responsive power piston means slidably disposed in said housing, and operably associated with said valve means, said power piston means having first and second positions relative to said housing corresponding to said closed and open positions, respectively, of said valve means;

a resilient spring retaining means, operatively associated with said power piston means and said housing, for releasably retaining said power piston means in its second position relative to said housing corresponding to said open position of said valve means until a force urging said power piston means from its second position toward its first position exceeds a retaining force provided by said retaining means, said resilient spring retaining means including:

spring means, longitudinally fixed relative to one of said power piston means and said housing, so that said spring means moves longitudinally with said one relative to the other of said power piston means and said housing, said spring means extending radially from said one toward the other of said power piston means and said housing, said spring means including:

a cantilevered spring finger having a fixed end fixedly connected to said one of said power piston means and said housing, and having a free end extending toward the other of said power piston means and said housing;

abutment means, longitudinally fixed relative to the other of said power piston means and said housing, so that said abutment means moves longitudinally with the other relative to the one of said power piston means and said housing; and wherein said spring means is engaged with said abutment means when said power piston means is in its second position relative to said housing and said valve means is open, thereby providing said retaining force which must be overcome to deflect said spring means over said abutment means to allow said power piston means to move from its second to its first position;

a first pressure conducting passage means for communicating a well annulus with a first side of said power piston means;

a second pressure conducting passage means for communicating said well annulus with a second side of said power piston means; and a pressure transmission retarding means, disposed in said second pressure conducting passage means, said retarding means providing:

a means for delaying communication of a relatively rapid increase in well annulus pressure to said second side of said power piston means for a sufficient time to allow a pressure differential across said power piston means to move said power piston means from its first to its second position to open said valve means;

a means for delaying communication of a relatively rapid decrease in well annulus pressure to said second side of said power piston means for a sufficient time to allow a pressure differential across said power piston means to overcome said retaining force of said retaining means and to move said power piston means from its second to its first position to close said valve means; and a means for communicating a relatively slow decrease in well annulus pressure to said second side of said power piston means quickly enough that a pressure differential across said power piston remains below that required to overcome said retaining force of said retaining means, so that said power piston means may remain in its second position and said valve means may remain open when well annulus pressure is slowly reduced to hydrostatic pressure.

2. The apparatus of claim 1, wherein:

said abutment means extends radially from the other toward the one of said power piston means and said housing.

3. The apparatus of claim 2, wherein:

said spring means is continuously slidably engaged with said other of said power piston means and said housing.

4. The apparatus of claim 1, wherein:

said spring means includes an annular base fixedly connected to said one of said power piston means and said housing, and said spring finger is one of a plurality of such spring fingers forming a spring collet,. said fixed ends of said spring fingers being integral with said annular base.

5. The apparatus of claim 4, wherein:

said annular base of said spring means is fixedly connected to a power mandrel of said power piston means; and said abutment means is an annular radially inward extending ledge of said housing.

6. The apparatus of claim 1, wherein:

said abutment means is an annular ledge of said other of said power piston means and said housing, said ledge being defined between first and second tapered upsets arranged to be engaged by said spring means as said power piston means moves from its first to its second position and from its second to its first position, respectively; and said first tapered upset has a less steep taper than does said second tapered upset, so that said power piston means can be moved from its first to its second position to open said valve means by a starting force less than that required to move said power piston means from its second to its first position to close said valve means.

7. The apparatus of claim 1, wherein:

said flow passage is a central flow passage; and said valve means is a full opening ball valve means.

8. The apparatus of claim 1, wherein:

said pressure transmission retarding means is a metering cartridge dividing said second pressure conducting passage means into a first portion between said second side of said power piston means and said metering cartridge, and a second portion between said metering cartridge and said well annulus, said metering cartridge having pressurizing and depressurizing passages disposed therethrough communicating said first and second portions of said second pressure conducting passage means, said metering cartridge including:

a first fluid flow restrictor disposed in said pressurizing passage for providing a first time delay in transmission of increase in well annulus pressure to said second side of said power piston means;

a first check valve means disposed in said pressurizing passage for allowing fluid flow therethrough from said second to said first portion of said second pressure conducting passage means;

a second fluid flow restrictor disposed in said depressurizing passage for providing a second time delay in transmission of decreases in well annulus pressure to said second side of said power piston means; and a second check valve means disposed in said depressurizing passage for allowing fluid flow therethrough from said first to said second portion of said second pressure conducting passage means.

9. The apparatus of claim 8, wherein:

said second time delay provided by said second fluid flow restrictor in said depressurizing passage has a duration approximately one-half of a duration of said first time delay provided by said first fluid flow restrictor in said pressurizing passage for an equivalent well annulus pressure change.

10. The apparatus of claim 8, wherein:

said first portion of said second pressure conducting passage means is at least partially comprised of a chamber filled with compressed gas.

11. An annulus pressure responsive valve apparatus, comprising:

a housing having a flow passage disposed therethrough;

valve means, disposed in said flow passage, and movable between a closed position wherein said flow passage is closed, and an open position wherein said flow passage is open;

differential pressure responsive power piston means slidably disposed in said housing, and operably associated with said valve means, said power piston means having first and second positions relative to said housing corresponding to said closed and open positions, respectively, of said valve means;

a resilient spring retaining means, operatively associated with said power piston means and said housing, for releasably retaining said power piston means in its second position relative to said housing corresponding to said open position of said valve means until a force urging said power piston means from its second position toward its first position exceeds a retaining force provided by said retaining means, said resilient spring retaining means including:

spring means, longitudinally fixed relative to one of said power piston means and said housing, so that said spring means moves longitudinally with said one relative to the other of said power piston means and said housing, said spring means extending radially from said one toward the other of said power piston means and said housing, said spring means including:

a ball radially slidable within a radial bore of said one of said power piston means and said housing; and a compressed spring received in said radial bore behind said ball and urging said ball toward the other of said power piston means and said housing;

abutment means, longitudinally fixed relative to the other of said power piston means and said housing so that said abutment means moves longitudinally with the other relative to the one of said power piston means and said housing; and wherein said spring means is engaged with said abutment means when said power piston means is in its second position relative to said housing and said valve means is open, thereby providing said retaining force which must be overcome to deflect said spring means over said abutment means to allow said power piston means to move from its second to its first position;

a first pressure conducting passage means for communicating a well annulus with a first side of said power piston means;

a second pressure conducting passage means for communicating said well annulus with a second side of said power piston means; and a pressure transmission retarding means, disposed in said second pressure conducting passage means, said retarding means providing:

a means for delaying communication of a relatively rapid increase in well annulus pressure to said second side of said power piston means for a sufficient time to allow a pressure differential across said power piston means to move said power piston means from its first to its second position to open said valve means;

a means for delaying communication of a relatively rapid decrease in well annulus pressure to said second side of said power piston means for a sufficient time to allow a pressure differential across said power piston means to overcome said retaining force of said retaining means and to move said power piston means from its second to its first position to close said valve means; and a means for communicating a relatively slow decrease in well annulus pressure to said second side of said power piston means quickly enough that a pressure differential across said power piston remains below that required to overcome said retaining force of said retaining means, so that said power piston means may remain in its second position and said valve means may remain open when well annulus pressure is slowly reduced to hydrostatic pressure.

12. The apparatus of claim 11, wherein:

said compressed spring is a stack of a Belleville spring washers.

13. The apparatus of claim 11, wherein:

said spring means frurther includes a solid disc between said ball and said compressed spring, said disc having a central depression therein for receiving said ball.

14. The apparatus of claim 11, wherein:

said radial bore is disposed in said housing, and said ball is partly received in said radial bore and extends radially inward out of said radial bore and into engagement with said power piston means; and said abutment means is an annular radially outward extending ledge of said power piston means.

15. The apparatus of claim 14, wherein:

said annular ledge extends radially outward from said power piston means by a relatively small distance on the order of 0.01 inch.

* * * * *